United States Patent [19]

Lee

[11] Patent Number: 5,018,542

[45] Date of Patent: May 28, 1991

[54] INSTRUMENT FOR SELECTIVITY SEPARATING STRANDS OF HAIR

[76] Inventor: Peter M. Lee, 11219 84th South, Seattle, Wash. 98178

[21] Appl. No.: 514,861

[22] Filed: Apr. 26, 1990

[51] Int. Cl.[5] ..... A45D 24/04

[52] U.S. Cl. ..... 132/139; 132/150; 132/161; 132/901

[58] Field of Search ..... 132/126, 137, 138, 139, 132/150, 161, 901, 208, 160

[56] References Cited

U.S. PATENT DOCUMENTS

| | | | |
|---|---|---|---|
| 754,949 | 3/1904 | Wilcox | 132/156 |
| 1,180,433 | 4/1916 | Robertson | 132/160 |
| 2,300,437 | 11/1942 | Solomon | 132/252 |
| 2,380,230 | 7/1945 | Demyanovich | 132/161 |
| 2,604,101 | 7/1952 | Helfgott | 132/160 |
| 2,915,071 | 12/1959 | Watkins | 132/161 |
| 3,468,318 | 9/1969 | Cook et al. | 132/270 |
| 3,473,540 | 10/1969 | Bulow | 132/139 |
| 3,477,446 | 11/1969 | Terrenzio et al. | 132/208 |
| 3,552,403 | 1/1971 | Sestito | 132/150 |
| 3,835,870 | 9/1974 | Sick | 132/160 |
| 3,952,755 | 4/1976 | Fisher | 132/161 |
| 4,760,855 | 8/1988 | DiLorenzo | 132/270 |
| 4,815,484 | 3/1989 | Stevenson | 132/137 |

FOREIGN PATENT DOCUMENTS

| | | | |
|---|---|---|---|
| 711531 | 6/1965 | Canada | 132/161 |
| 0276969 | 8/1988 | European Pat. Off. | 132/137 |
| 823329 | 12/1951 | Fed. Rep. of Germany | 132/150 |
| 1043721 | 11/1953 | France | 132/126 |
| 1235622 | 5/1960 | France | 132/161 |

*Primary Examiner*—John J. Wilson
*Assistant Examiner*—Frank A. LaViola
*Attorney, Agent, or Firm*—Glenn D. Bellamy

[57] ABSTRACT

A comb for selectively separating strands of hair for individual treatment includes an elongated base and a plurality of teeth positioned at spaced-apart locations along the length of the base. Each tooth includes a shaft which extends outwardly from the base to a free end. The teeth include a hair-engaging portion at the free end of a shaft which is substantially linearly straight and smooth from the base to the hair-engaging portion. The hair-engaging portion is positioned to engage only selected strands of hair while allowing non-selected strands to fall freely from between the teeth as the comb is lifted, moving the teeth in a direction toward the base through the lock of hair. Each hair-engaging portion includes a tine member which extends outwardly from the shaft to define a substantially open hook throat. Each tine member is on a common side of each tooth so that the selected strands may be released from each hook throat by a single longitudinal movement of the base. The teeth having a hair-engaging portion may be positioned separately on the base from other teeth which may not have a hair-engaging portion, or both types of teeth may be positioned in an alternating arrangement together on a single side of the base.

5 Claims, 4 Drawing Sheets

10
12
14
16
18
19
20
21
22
24
26
28
30
32
34
36
38
39
40
42
44
46

Fig. 11
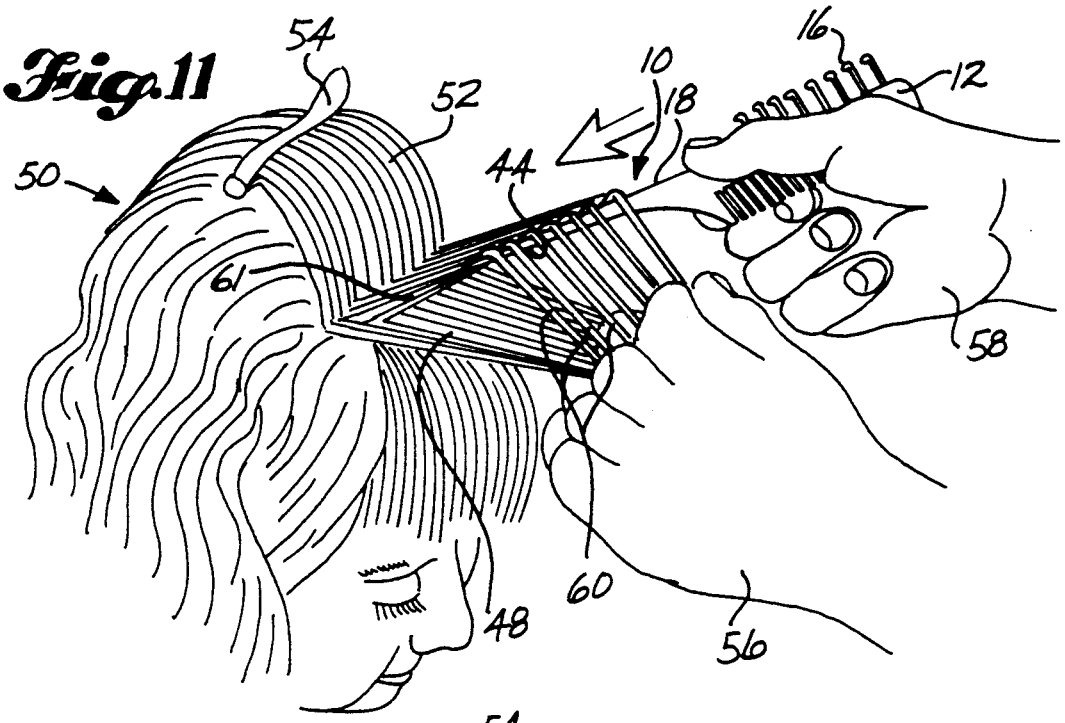
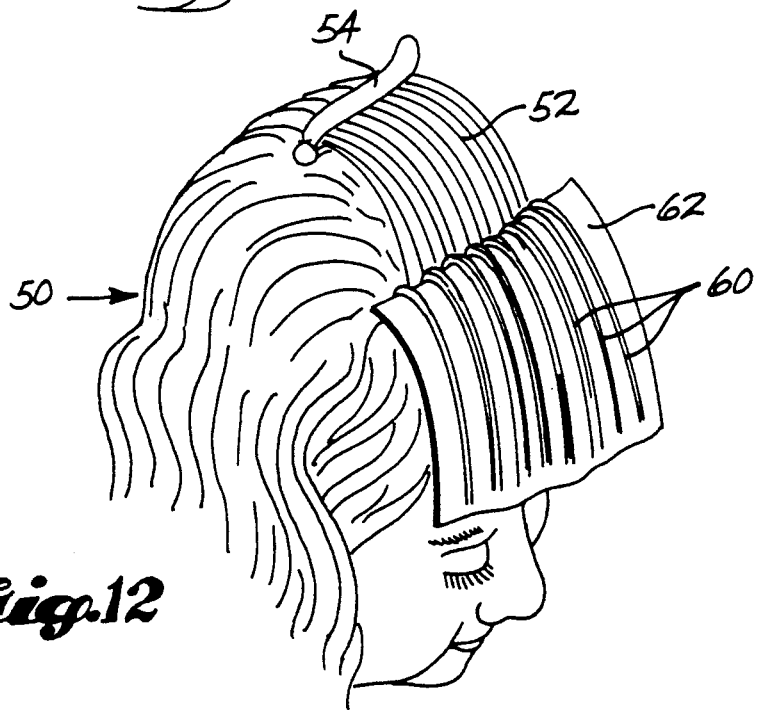
Fig. 12

INSTRUMENT FOR SELECTIVITY SEPARATING STRANDS OF HAIR

DESCRIPTION

1. Technical Field

This invention relates to a comb having hair-engaging teeth for selectively separating strands of hair for the purpose of color treating or highlighting the selected strands of hair.

2. Background Art

A hair treatment which is presently popular and which has been for many years is that of color highlighting or "frosting" by selectively color treating separate strands of hair. Generally, this is accomplished by applying a color treatment solution to only those strands selected to be treated while protecting the remaining hair from treatment.

Separation and selective treatment of hair strands has previously been accomplished by first placing a perforated cap over the head of the person whose hair is to be treated and then pulling strands of hair through perforations in the cap using a hook instrument. The hairs pulled through the cap could then be treated with a solution while the remaining hair and scalp was protected from the solution by the cap. Devices for carrying out treatment according to this general method are shown in U.S. Pat. Nos. 3,468,318; 3,477,446; and 4,760,855.

U.S. Pat. No. 3,552,403 shows a device which is suitable for selectively separating relatively short strands of hair. That device is in the form of an elongated comb which includes a series of coplanar hooks arranged to extend outwardly from the back of the comb. The hooks are used to select strands from a lock of hair by lifting the hooks upwardly through the lock. Because of the shape and arrangement of the hooks, the instrument must be pulled through the entire length of the selected strands of hair to release the selected strands from the hooks.

U.S. Pat. No. 3,835,870 shows a device in the form of a comb having wide teeth with foot portions which, when pulled through hair, hold some strands against the scalp and allow alternate strands to pass between the teeth. These strands are then manually lifted with another instrument and separated for selective treatment.

A presently more common method of separating strands of hair for special treatment is to first comb out a thin lock or hank of hair, then to weave a thin rod with a hook end or "crochet hook" type instrument through the lock of hair, and then to retract the instrument in a manner which pulls out the selected strands of hair.

Each of the above-described methods or instruments are time consuming and require substantial training and practice to be used successfully and proficiently, or require that a separating device be pulled through the entire length of the hair strands, a step which is unacceptably difficult with relatively long hair.

SUMMARY OF THE INVENTION

The present invention provides an instrument similar in concept to that shown in U.S. Pat. No. 3,552,403, except that it includes many greatly improved features and aspects not previously found in the prior art. The present instrument is in the form of a comb which may be used to quickly and easily separate selected strands of hair for individual treatment. The comb includes an elongated base with a plurality of teeth extending outwardly from the base to a free end. The teeth are positioned along the length of the base and include a hair-engaging hook portion at each free end. The hook portion includes a tine which extends from the tooth substantially toward a single longitudinal direction of the base to present a relatively open hook throat.

In use, a relatively flat lock or hank of hair is combed from the head and held in one hand in a position which could otherwise be used for the tedious weaving with a "crochet hook" type instrument. Instead, however, the teeth of the present invention are simply pulled through the lock of hair to a midpoint and then lifted through the lock of hair, each hair-engaging hooked end lifting with it a selected strand of hair. The selected strands may be released from the hook ends by simply a slight longitudinal movement of the base of the comb a sufficient distance to release the strands of hair from the hook ends and to draw the teeth upwardly therethrough, free of the hair with the hairdresser's finger or the "rat tail" portion of the comb handle.

The selected strands are then easily separated from the remainder of the lock of hair. In this manner, relatively long hair may be selectively separated without the need for pulling the instrument through the entire length of the hair. This is an important aspect of the invention as the random selection of strands from a lock of hair causes crossover and tangling of individual hairs. In order to create natural-looking hair coloration or highlighting, the strands of hair must be separately treated along their entire length from root to end. Entanglements at the base of the hairs can cause either the selected strands not to be treated thoroughly at their base or allow bleed-over of the treatment onto nonselected hairs near their roots. In relatively long hair, there will be entanglements outwardly from where the strands were separated regardless of how well the lock of hair was combed or brushed prior to separation. These tangles should be separated gently by the hairdresser by using either a finger or "rat tail" comb handle. If instead, however, the hooks of the selecting instrument are pulled through the entire length of the hair, it is likely that many hairs will be unnecessarily and painfully broken or detached from the subject's head.

Another feature of the invention is that the instrument may be provided with straight comb teeth and hooked comb teeth arranged in an alternating pattern and with the hair-engaging hook portions of the hook teeth positioned outwardly beyond the free ends of the straight comb teeth. This arrangement allows a hairdresser to use the instrument for both a tradition comb and a hair-selecting instrument with the other features of the present invention without the need for reversing or exchanging the instrument.

The instrument of the present invention may be used rapidly and successfully by experienced and novice hairdressers alike. Other aspects and features of the present invention will become apparent from a reading of the following detailed description of a preferred embodiment, the following claims, and inspection of the various figures of the drawing, all of which are a part of the present disclosure.

BRIEF DESCRIPTION OF THE DRAWINGS

Like reference numerals are used to indicate like parts throughout the various figures of the drawing, wherein:

FIGS. 7–12 are sequential pictorial views showing one embodiment of the present invention in use.

BEST MODE FOR CARRYING OUT THE INVENTION

Figures 1, 2, 3, 4, 5, 6:
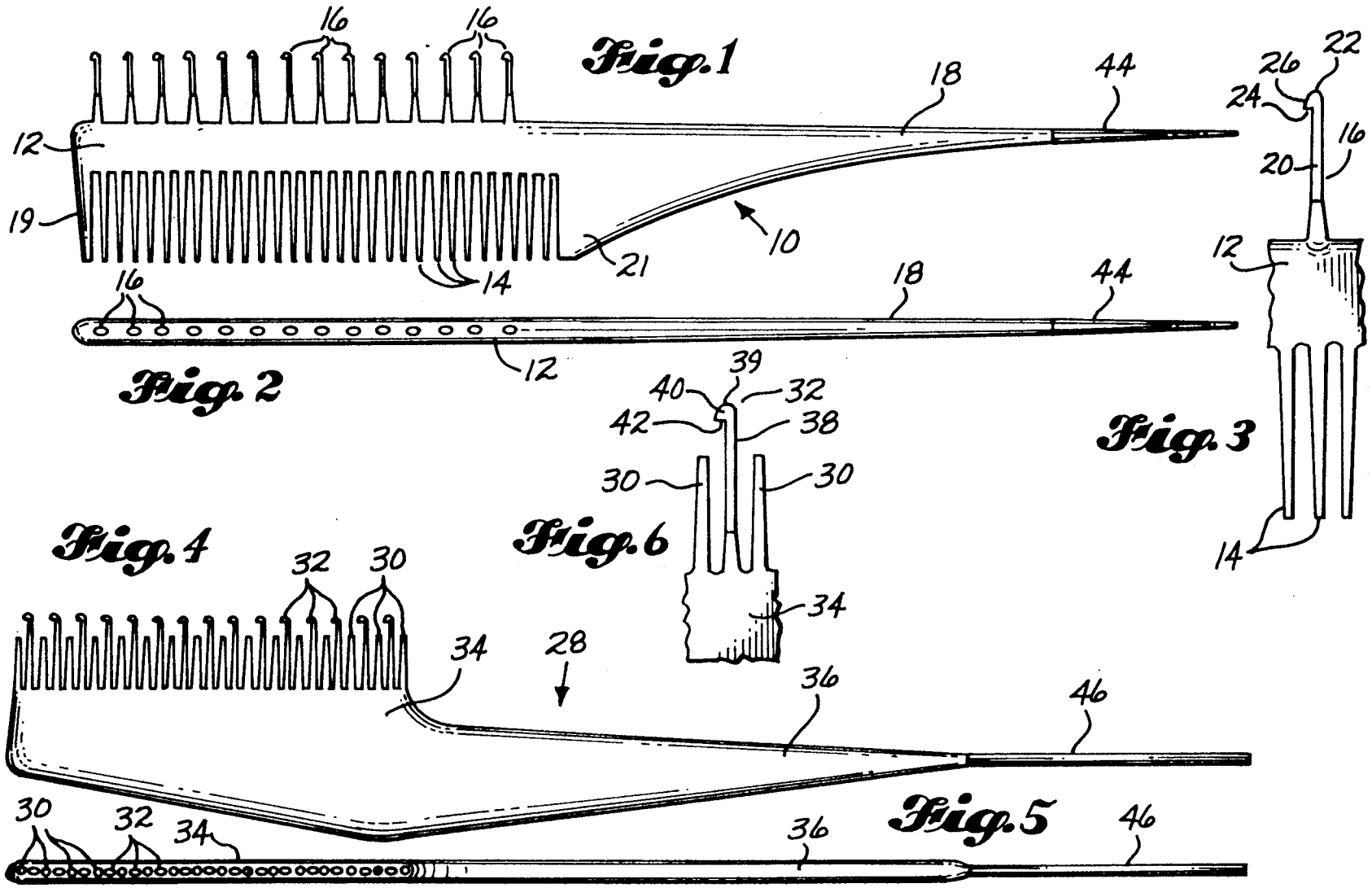
FIG. 1 is a side view of a first preferred embodiment of a weaving comb according to the present invention.
FIG. 2 is an edge view of the comb shown in FIG. 1.
FIG. 3 is a fragmentary detailed view of a section of the teeth of the embodiment shown in FIG. 1.
FIG. 4 is a side view of a second preferred embodiment of a weaving comb according to the present invention.
FIG. 5 is an edge view of the comb shown in FIG. 4.
FIG. 6 is a fragmentary detailed view of the teeth of the comb shown in FIG. 4.

Referring first to FIG. 1, therein is shown at 10 a preferred embodiment of the present invention of an instrument for selectively separating strands of hair. The device !0 is in the nature of a comb having oppositely-directed sets of teeth extending outwardly from a spine or base portion !2. Referring now also to FIGS. 2 and 3, the first set of teeth includes a plurality of longitudinally-aligned tooth members 14 which are in the nature of an ordinary and typical comb. These teeth 14 are relatively straight, thin members which extend outwardly from the base 12 substantially parallel to one another with a predetermined and regular spacing therebetween. Extending longitudinally from the base portion 12 is a handle portion 18 which provides a hand-gripping area for the instrument 10 which is free of teeth. The teeth 14 are preferably made from a material which allows them to be somewhat flexible and resilient. If desired, at each end of the row of teeth 14, may be a heavier, relatively rigid portion 19, 21 extending outwardly from the base 12 as is commonly done with typical combs.

Extending outwardly from the base 12 in a direction opposite from the comb teeth 14 are a plurality of hair-engaging hook-teeth members 16. The hook-teeth members 16 extend outwardly from the base portion 12 substantially parallel to one another and in the same plane, and are aligned along the length of the base 12 substantially opposite the comb teeth members 14.

Referring now specifically to FIG. 3, therein is shown an enlarged detail view of a section of the instrument 10. Each hook-tooth 16 includes a shaft portion 20 which extends outwardly from the base portion 12 to a free end. At the free end is a hair-engaging hook portion 22 including a radially-extending tine 26 which defines a hook throat 24. As will be further described later, the width of the hook throat 24 determines the amount of hair which will be caught and lifted by each hook tooth 16. As used herein, the term "strand" is intended to mean a plurality of individual hairs. The number of individual hairs in a strand will vary, but are relatively few compared to a "lock" or "hank" of hair. The total number of hook teeth 16 and spacing between them determines the total number of strands selected.

The tine 26 extends radially from the shaft 20 on the side of the shaft toward the longitudinal extension of the base 12. As shown in FIG. 1, the tine 26 on each tooth 16 extends in the same longitudinal direction, e.g., the longitudinal direction opposite to the handle 18. The shaft 20 is substantially linearly straight and smooth from the base 12 to the hook portion 22. In this manner, strands of hair will be engaged only with the hook portion 22 and will otherwise be allowed to move freely over the shaft portion 20 and to fall freely from between the teeth 16, except for the selected strands which are engaged by the throat 24 of the hook portion 22.

Referring now to FIGS. 4, 5 and 6, therein is shown an alternate preferred embodiment 28 of an instrument according to the present invention. In this embodiment 28, a plurality of standard comb teeth 30 and a plurality of hooked teeth 32 are alternately positioned in a single row extending outwardly from a spine or base portion 34. Longitudinally extending from the base 34 is a handle portion 36 which is free of teeth 30, 32.

Referring now in particular to FIG. 6, each hook tooth 32 includes a shaft portion 38 which extends outwardly from the base 34 to a free end. At the free end is a hair-engaging hook portion 39, including a hook tine 40 which extends radially outwardly from the shaft 38 and defines a hook throat 42. Each hook tine 40 extends toward the longitudinal extension of the base 34 and substantially perpendicular to the shaft 38. As shown in FIG. 4, each hook tine extends toward the same longitudinal direction, e.g., opposite to the handle 36. As previously described, the shaft portion 38 is substantially linearly straight and smooth from the base 34 to the hook portion 39. The standard comb teeth 30 are substantially linearly straight and smooth along their entire length.

In preferred form, the hair-engaging hook portion 39 of each hook tooth 32 is positioned outwardly beyond the free end of the straight comb teeth 30. This position is considered to be desirable in that it allows all of the comb teeth 30, 32 to be used together in the nature of a typical comb when the teeth 30, 32 are fully engaged through the hair along the full depth of the teeth 30, 32. The outward positioning of the hair-engaging hook portions 39 allows the instrument 28 to be used as a strand-selecting device without the need for changing instruments or even repositioning the instrument in the hairdresser's hand. This arrangement also allows the selected strands of hair to be more readily released from the hook throat 42 by a longitudinal movement of the base 34. As will be discussed below with respect to the use of the instrument 28, this positioning is important to efficient performance of the instrument 28, although it would be functional, in a limited way, even if the comb teeth 30 were extended to or beyond the length of the hook teeth 32.

At the free end of the handle portion 18, 36 of either embodiment 10, 28, may be a "rat tail" or skewer portion 44, 46 comprising a relatively thin but rigid extension of the handle portion 18, 36. The skewer portion 44, 46 may be tapered to a point or extend with a relatively uniform cross-section to a blunted end. Alternatively, the end may include 15 a hook tine (not shown.) The use of this feature will be described in detail later.

Either of the illustrated embodiments 10, 28 may be formed, as by molding, from a unitary piece of thermoplastic material such as nylon, polyethylene, hard rubber, or any other suitable synthetic material. The device 10, 28 may also be formed entirely of metal or a combination of metal and plastic materials. In preferred form, the base 12, 34, handle 18, 36, and comb teeth 14, 30 are formed of a synthetic plastic material having sufficient rigidity and strength to maintain its shape while being pulled through hair, but having sufficient resiliency to allow minor bending without breakage The hook teeth 16, 32 and skewer portion 44, 46 may be formed of a metal material with such parts being encapsulated into the base 12, 34 and handle 18, 36 portions as they are being formed or by insertion of such parts into preformed sockets in the base 12, 34 and handle 18, 36 portions. The particular material from which the device 10, 28 is formed or manner in which it is manufactured is not critical to the function and performance of the present invention.

The instrument of the present invention 10, 28 may be used to selectively separate strands of hair to which a hair-treating agent is to be applied or which may be separately cut treating agent is to be applied or which may be separately cut for adding texture or thinning bulk from the hair. The hair-treating agent may be in the nature of a colorant, curling or straightening formula, or any other treatment which is applied to only selected strands of hair.

Figure 7:
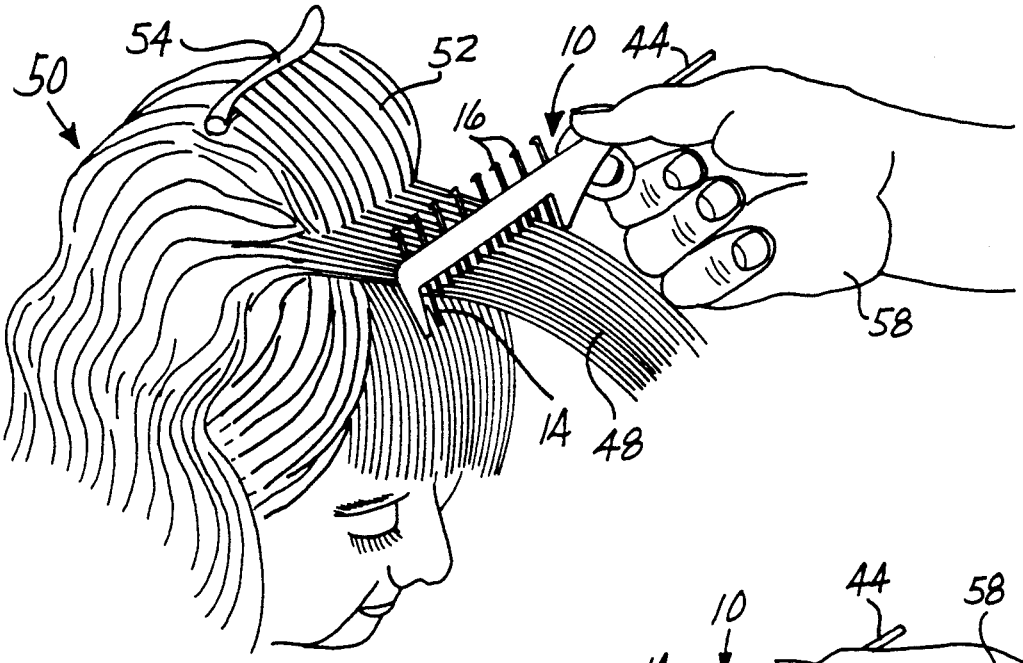
Figure 8:
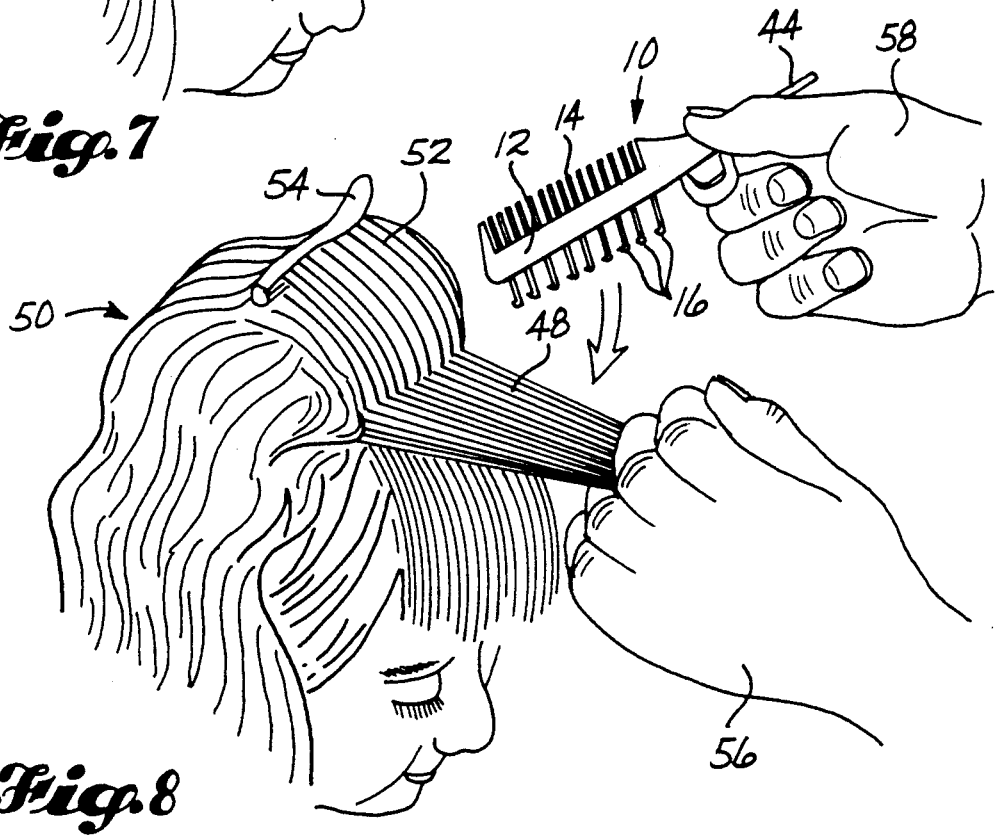

Use of either of the illustrated embodiments 10, 28 is carried out in essentially the same way. Use of the first embodiment 10 is illustrated in FIGS. 7–12. In use, a hank or lock 48 of the subject's hair 50 is prepared by combing the lock of hair 48 with the common comb teeth 14 of the instrument 10 in order to remove any tangles and to arrange the strands of hair in substantially parallel order. This is shown in FIG. 7. Other portions 52 of the subject's hair 50 may be held out of the way with a typical hair pin or clip 54. Referring to FIG. 8, the combed lock of hair 48 is held by the hairdresser between the fingers of one hand 56 while the other hand 58 moves the hook teeth 16 of the instrument 10 downwardly through the lock of hair 48. The instrument 10 may be moved from its orientation shown in FIG. 7 to that shown in FIG. 8 simply by rotation of the device 10 along its longitudinal axis. In this manner, it is not necessary for the hairdresser to change instruments between steps or to use more than one instrument at the same time.

Figure 9:
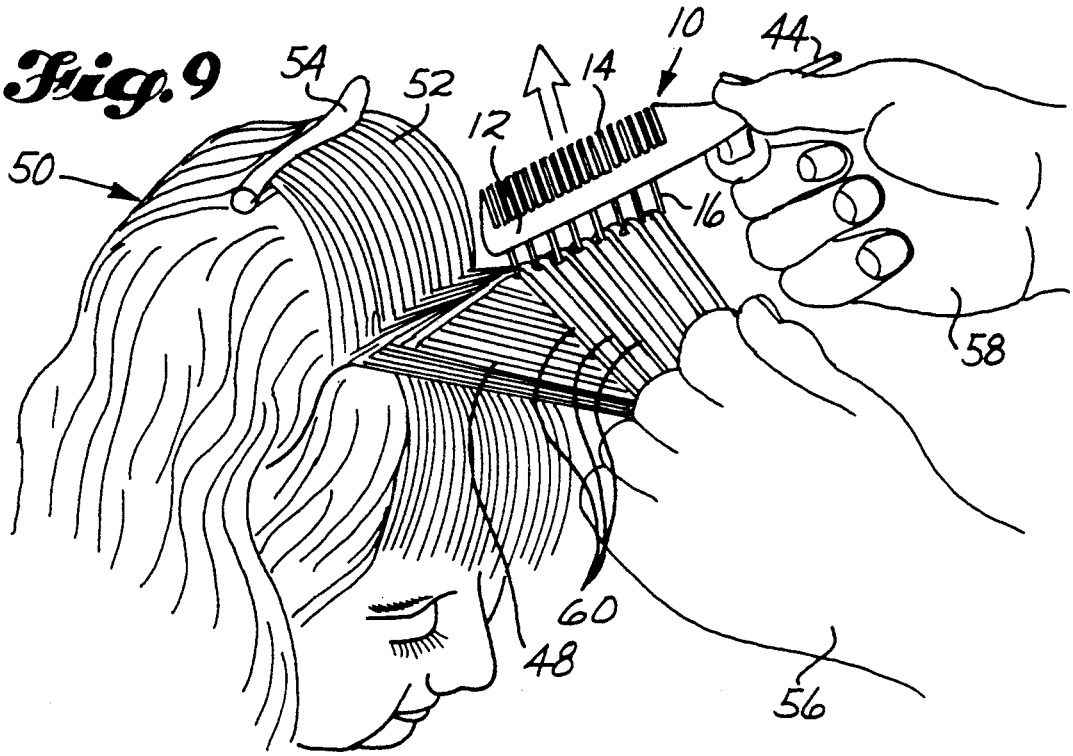

The hook teeth 16 of the instrument 12 are moved through the look of hair 48 to a position midway along its length between the hairdresser's hand 56 and the subject's scalp. The instrument 10 is then lifted, as shown in FIG. 9. As it is lifted, each of the hook teeth 16 carries with it selected strands of hair 60. The grip of the hairdresser's first hand 56 is loosened sufficiently to allow the selected strands 60 to longitudinally slide out from between the fingers. The unselected strands of hair fall freely from between the hook teeth 16 and remain in their original position 48.

The amount of hair which is selected in each strand 60 is determined by the width of the hook throat 24, 42 or length of the tine 26, 40 of the hook portion 22, 39 of each hook tooth 16, 32. The volume of hair in the selected strands 60 relative to the hair in the unselected lock 48 is dependent upon both the above-described hook portion size and total number or spacing of the hook teeth 16, 32. If a greater volume of hair is to be selected, an increased number of hook teeth 16, 32 are used and they are more closely spaced along the base 12, 34. The series or row of hook teeth 16, 32 may be evenly spaced along the length of the base 12 or unevenly spaced if a more random selection or finished look is desired. Also, if thinner selected strands 60 are desired, the above-described process may be repeated using the plurality of initially-selected strands 60 as the lock of hair from which a minority of strands are again selected.

Figure 10:
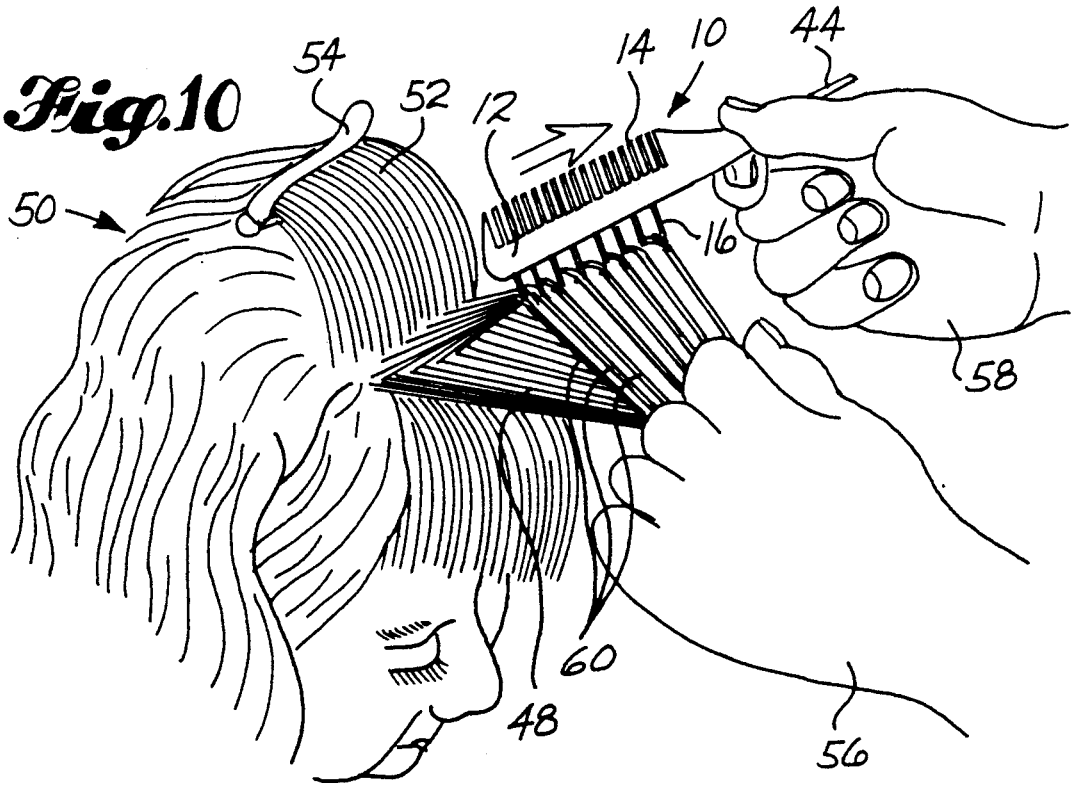

Once the strands 60 have been selected and lifted as shown in FIG. 9, the hook teeth 16 of the instrument 10 may be released from the strands 60 simply by first lessening the upward tension which the hook portions 22, 39 place on the strands 60, then moving the instrument 10 longitudinally toward its handle portion 18 or skewer portion 44. This movement is shown in FIG. 10. Because the tine portion 26, 40 of each hair-engaging hook portion 22, 32 extends substantially perpendicular to or only slightly angled from perpendicular relative to the length of the shaft portion 20, 38, the hook throat 24, 42 is relatively open and allows the selected strands 60 to easily be released therefrom when the base 12 is longitudinally moved. The hook teeth 16 may then be lifted from between the selected strands 60. If the tine portion 26, 40 projects from the shaft portion 20, 38 at a sharp angle toward the base 12, 34, or it extends a significant distance back toward the base 12, this simple method of releasing the selected strands 60 will be difficult, if not impossible, to accomplish and it will be necessary to release the hook teeth 16, 32 by pulling them through the length of the selected strands 60. In any event, for the hair-engaging hook portions 22, 39 to release all of the selected strands 60 with a single longitudinal movement of the instrument 10, it is necessary that each hook tine 26,40 be oriented in a common direction or on a common side of the shaft 20, 38, preferably in the direction of the longitudinal extension of the base 12, 34 opposite the handle 18, 36.

Referring to FIG. 11, after the hooked teeth 16, 32 have been released, the skewer portion 44, 46 or rat tail handle 18, 36, is inserted between the selected strands 60 and remaining lock of hair 48. Because the selected strands 60 are pulled from various depths within the lock of hair 48, there will typically be at least some hairs 61 which remain entangled near the roots of the selected strands 60 and lock of hair 48 or which otherwise bridge between the selected strands 60 and remaining lock 48. With the hairdresser's finger or the rat tail handle 18, 44 of the instrument 10 inserted under the selected strands 60, the strands 60 may be gently and easily separated along their entire length without causing unnecessary and painful breaking or pulling of hairs which would occur if the hooked teeth 16, 32 were forced through the entire length of the selected strands 60. Of course, this is less of a problem when working with relatively short hair.

The selected strands 60 are then grasped by one of the hair dresser's hands 56 while the remaining look of hair 48 is allowed to fall free or is held out of the way with a clip or hairpin. Referring to FIG. 12, a piece of flexible material 62, preferably a conventional foil wrapper or the like, is slid beneath the selected strands of hair 60 to shield the remaining hair 50 as treatment is applied to the selected strands 60 in a typical and well-known manner. The treated strands of hair are then folded into the wrapper 62 and put aside while other portions of the subject's hair 50 are selected and treated.

The embodiment shown in FIGS. 4–6 is utilized in a manner identical to that described above.

The illustrated embodiments described and their method of use are for the purpose of example only. Many variations to the form or arrangement of elements in the devices 10, 28 may be made without departing from the spirit and scope of the invention. Therefore my patent protection is not to be limited by the illustrated embodiments or description of a method of use, but rather by the following claim or claims interpreted according to accepted doctrines of claim interpretation, including the doctrines of equivalents.

What I claimed is:

1. A comb for selectively separating strands of hair for individual treatment, said comb comprising:

a base having a length;

a plurality of teeth positioned at pre-selected spaced-apart locations along the length of said base, each tooth including a shaft which extends outwardly from said base to a free end and a hair-engaging hook portion at said free end, said hair-engaging hook portion including a tine member which extends outwardly from said shaft, each said tine member being positioned on a common side of each of said teeth substantially toward a direction of the base's length [longitudinal extension], said shaft being substantially linearly straight and smooth from said base to said hair-engaging hook portion, and a hook throat being defined by said tine member between said tine member and said shaft such that said hook throat is substantially open and substantially perpendicular to said shaft;

said hair-engaging hook portion being positioned to engage only selected strands of hair while allowing non-selected strands to fall freely from between said teeth as the comb is lifted, moving said teeth in a direction toward said base through a lock of hair, and such that [longitudinal] movement of said base substantially only in a direction of said base's length opposite the position of said tine members will substantially release said selected strands of hair from said hair-engaging hook portion of each tooth.

2. A comb according to claim 1, further comprising a plurality of secondary teeth, each said secondary tooth being positioned between teeth which include a hair-engaging hook portion at the free end, each said secondary tooth including a shaft which extends outwardly from said base to a free end and being said free end such that the spacing between adjacent tooth shafts is effectively reduced without reducing the preselected spacing between said hair-engaging hook portions.

3. A comb according to claim 2, wherein the hair-engaging hook portion of each of said plurality of teeth is positioned outwardly from said base beyond the free end of each said secondary tooth.

4. A comb according to claim 1, wherein said base includes a handle portion which is free of teeth and which extends longitudinally outwardly therefrom to a free end, said handle portion including a thin skewer portion at said free end.

5. A comb according to claim 2, wherein said base includes a handle portion which is free of teeth and which extends longitudinally outwardly therefrom to a free end, said handle portion including a thin skewer portion at said free end.

* * * * *

UNITED STATES PATENT AND TRADEMARK OFFICE

CERTIFICATE OF CORRECTION

PATENT NO. : 5,018,542

DATED : May 28, 1991

INVENTOR(S) : Peter M. Lee

It is certified that error appears in the above-identified patent and that said Letters Patent is hereby corrected as shown below:

ON TITLE PAGE and in,

Col. 1, lines 1-5 the title of the patent, "SELECTIVITY" should be -- SELECTIVELY --.

On the cover page, under "U.S. PATENT DOCUMENTS", "2,380,230 by Demyanovich" should be -- 2,380,730 --.

Col. 3, line 20, "device !0" should be -- device 10 -- and in line 22, "portion !2" should be -- portion 12 --.

Col. 4, line 53, delete the numeral "15".

Col. 4, line 65, there is a period after "breakage".

UNITED STATES PATENT AND TRADEMARK OFFICE

CERTIFICATE OF CORRECTION

PATENT NO. : 5,018,542

DATED : May 28, 1991

INVENTOR(S) : Peter M. Lee

It is certified that error appears in the above-identified patent and that said Letters Patent is hereby corrected as shown below:

Col. 5, lines 10 and 11, delete " treating agent is to be applied or which may be separately cut".

Col. 5, line 37, "look" should be -- lock --.

Col. 6, line 68, "What I" should be -- What is --.

Claim 1, col. 7, line 13, delete "[longitudinal extension]".

Claim 1, col. 7, line 25, delete "[longitudinal]".

Claim 2, col. 8, line 9, after "being", insert -- substantially linearly straight and smooth from said base to --.

Signed and Sealed this

Tenth Day of November, 1992

*Attest:*

DOUGLAS B. COMER

*Attesting Officer*

*Acting Commissioner of Patents and Trademarks*